United States Patent [19]

Kitahara

[11] Patent Number: 4,580,539

[45] Date of Patent: Apr. 8, 1986

[54] AIR-FUEL RATIO CONTROL APPARATUS

[75] Inventor: Tsuyoshi Kitahara, Ina, Japan

[73] Assignee: Nissan Motor Co., Ltd., Yokohama, Japan

[21] Appl. No.: 705,924

[22] Filed: Feb. 26, 1985

[30] Foreign Application Priority Data

Feb. 27, 1984 [JP] Japan ..... 59-34437

[51] Int. Cl.[4] ..... F02B 3/00

[52] U.S. Cl. ..... 123/440; 204/15; 204/428; 123/491

[58] Field of Search ..... 123/440, 489; 204/408, 204/409, 427, 428, 1 T, 15

[56] References Cited

U.S. PATENT DOCUMENTS

| | | | |
|---|---|---|---|
| Re. 29,741 | 8/1978 | Norimatsu et al. | 123/440 |
| 3,964,457 | 6/1976 | Coscia | 123/440 |
| 4,088,095 | 5/1978 | Aono | 123/440 |
| 4,101,403 | 7/1978 | Kita et al. | 123/440 |
| 4,129,099 | 12/1978 | Howarth | 204/15 |
| 4,132,615 | 1/1979 | Linder | 204/428 |
| 4,140,611 | 2/1979 | Vacgashi | 204/15 |
| 4,207,159 | 6/1980 | Kimura et al. | 123/440 |
| 4,210,106 | 7/1980 | Wessel | 123/440 |
| 4,224,113 | 9/1980 | Kimura et al. | 123/440 |
| 4,334,510 | 6/1982 | Croset | 123/440 |
| 4,385,612 | 5/1983 | Masaka | 123/440 |

*Primary Examiner*—Ronald B. Cox

*Attorney, Agent, or Firm*—Schwartz, Jeffery, Schwaab, Mack, Blumenthal & Evans

[57] ABSTRACT

A feedback control is effected during warming-up operation so as to adjust an actual air-fuel ratio to a target value. A sensing element is used to probe exhaust gases to detect an air-fuel ratio of a fuel-rich mixture that is required for warming up the engine. The amount of fuel injection is corrected so that the actual air-fuel ratio is adjusted to a target value displaced to the rich side from the stoichiometric ratio.

14 Claims, 12 Drawing Figures

Q
N
BASIC FUEL INJECTION
1
Tp
THROTTLE SW.
Tw
CORRECTION
2
T1
FUEL-CUT: KFC
3
THROTTLE SW.
N
v
T2
A/F CORRECTION : α
4
T3
BATTERY V. CORRECTION : Ts
5
VB
Ti
POWER TRANSISTOR
6
INJECTOR
7
O2 SENSOR
8
A/F DETECTION CKT.
9
Vi
ΔV = Vi − TL
14
ΔV
α = ∫ΔVdt
15
TL
13
S
WARM-UP DECISION
12
Tw
TARGET A/F DETERMINATION (WARM-UP)
10
Tw
STARTER SW. ON/OFF
TL (C)
TARGET A/F DETERMINATION (AFTER WARM-UP)
11
Tp
N
v
TL (H)

AIR-FUEL RATIO CONTROL APPARATUS

BACKGROUND OF THE INVENTION

The present invention relates to an air-fuel ratio control apparatus for controlling an air-fuel ratio of a fuel mixture supplied to an internal combustion engine.

In order to meet recently growing demands to improve exhaust gas purification, driveability and fuel economy, an air-fuel ratio control where an air-fuel ratio of a fuel mixture supplied an automotive internal combustion engine is controlled spreads over car manufacturers. One example of control apparatuses implementing such an air-fuel ratio control is described in a technical paper "ECCS L-SERIES ENGINE" issued by Nissan Motor Company Limited in 1979.

With this known control apparatus, a basic amount of fuel injection is determined for intake air and engine speed, the basic amount of fuel injection is corrected in accordance with each engine operating condition of an engine, and this result is further corrected with a feed back correction coefficient that is determined in response to a result of comparison between an actually detected air-fuel ratio obtained by sensing the oxygen concentration within exhaust gases by means of an oxygen sensor. As a result of the feedback control, the actually detected air-fuel ratio is adjusted to the stoichiometric ratio whereupon a three-way catalytic converter works most effeciently in purifying the exhaust gases.

Since it aims at maintaining the air-fuel ratio at the stoichiometric ratio, the above mentioned feedback control (closed loop control) is clamped or suspended during an operating state which requires rich mixtures, such as warming-up operation after start-up or cranking of an engine at low temperatures. Thus, the apparatus effects an open loop control during the warming-up operation using a cranking and after-cranking operation related correction coefficient and an engine coolant temperature related correction coefficient.

That is, during the warming-up operation after starting up the engine, the feedback correctrion coefficient is set and fixed at 1 (100%) so as to suspend the feedback control, and after the warming-up operation, the feedback control is initiated by using the outut from the oxygen sensor.

However, the conventinal air-fuel ratio control apparatus of the above kind presents a problem, which is derived from the open loop control of the air-fuel ratio carried out during warming-up operation, that the air-fuel ratio during the warming-up operation differs from one engine to another owing to the variation in performance of each engine itself, and the variations in performance of each air flow sensor and injector in the case of a fuel injection type engine and the variation in performance of each carburetor in the case of a caburetor injection type engine, thus allowing fuel mixture to become too lean or too rich for the engine operation. In the case the mixture is too rich, the fuel economy is deteriorated, and in the case the fuel mixture is too lean, the operation of the engine lose its stability.

SUMMARY OF THE INVENTION

An object of the present invention is to carry out a feedback control even during warming-up operation of an internal combustion engine so as to maintain air-fuel ratio at optimal target value for the warming-up operation.

According to the present invention, there is provided an air-fuel ratio control apparatus for controlling an air-fuel ratio of a fuel mixture supplied to an internal combustion engine which effects combustion of the fuel mixture to produce exhaust gases, comprising:

means for detecting the air-fuel ratio of the fuel mixture over a range from a rich range portion thereof to a lean range portion thereof by probing the exhaust gases resulting from combustion of the fuel mixture and generating an actual air-fuel ratio indicative signal;

means for detecting a warming-up operation of the internal combustion engine and generating a warming-up operation indicative signal;

means for determining a first target value indicative of an air-fuel ratio value optimal for warming-up operation in response to the presence of said warming-up operation indicative signal, determining a second target value indicative of an air-fuel ratio value for normal operation of the internal combustion engine after the warming-up operation in response to the absence of said warming-up operation indicative signal, and generating a target value indicative signal indicative of said first target value in reponse to the presence of said warming-up operation indicative signal and said second target value in response to the absence of said warming-up operation indicative signal;

means for comparing said actual air-fuel ratio indicative signal with said target value indicative signal and generating a difference indicative signal indicative of a difference therebetween; and means for controlling the air-fuel ratio of the fuel mixture in response to said difference indicative signal in such a manner as to reduce said difference indicative signal to zero.

According to another aspect of the present invention, there is provided a method for controlling an air-fuel ratio of a fuel mixture supplied to an internal combustion engine which effects combustion of the fuel mixture to produce exhaust gases, comprising:

providing a sensing element comprising a partition having a first side and a second side opposite to said first side, said partition defining on said first side an atmospheric air receiving portion communicating with the ambient atmosphere and on said second side a gas receiving portion communicating with a source of the exhaust gases, said partition having at least a portion formed of an oxygen solid ion-conductive eletrolyte, first electrode means exposed to said atmospheric air receiving portion, second electrode means exposed to said gas receiving portion, said first and second electrode means interposing said electrolyte therebetween, and means for restricting gas diffusion of said exhaust gases to said gas receiving portion;

causing an electric current to flow between said first and second electrode means through said electrolyte in such a manner as to cause migration of oxygen ions through said electrolyte between said atmospheric air receiving portion and said gas receiving portion so as to keep an oxygen partial pressure ratio across said electrolyte constant;

detecting said electric current and generating an actual air-fuel ratio indicative signal;

detecting a warming-up operation of the internal combustion engine and generating a warming-up operation indicative signal;

determining a first target value indicative of an air-fuel ratio value optimal for warming-up operation in response to the presence of said warming-up operation indicative signal, determining a second target value indicative of an air-fuel ratio value for normal operation of the internal combustion engine after the warming-up operation in response to the absence of said warming-up operation indicative signal, and generating a target value indicative signal indicative of said first target value in reponse to the presence of said warming-up operation indicative signal and said second target value in response to the absence of said warming-up operation indicative signal;

comparing said actual air-fuel ratio indicative signal with said target value indicative signal and generating a difference indicative signal indicative of a difference therebetween; and controlling the air-fuel ratio of the fuel mixture in response to said difference indicative signal in such a manner as to reduce said difference indicative signal to zero.

DETAILED DESCRIPTION OF THE INVENTION

Figure 1:
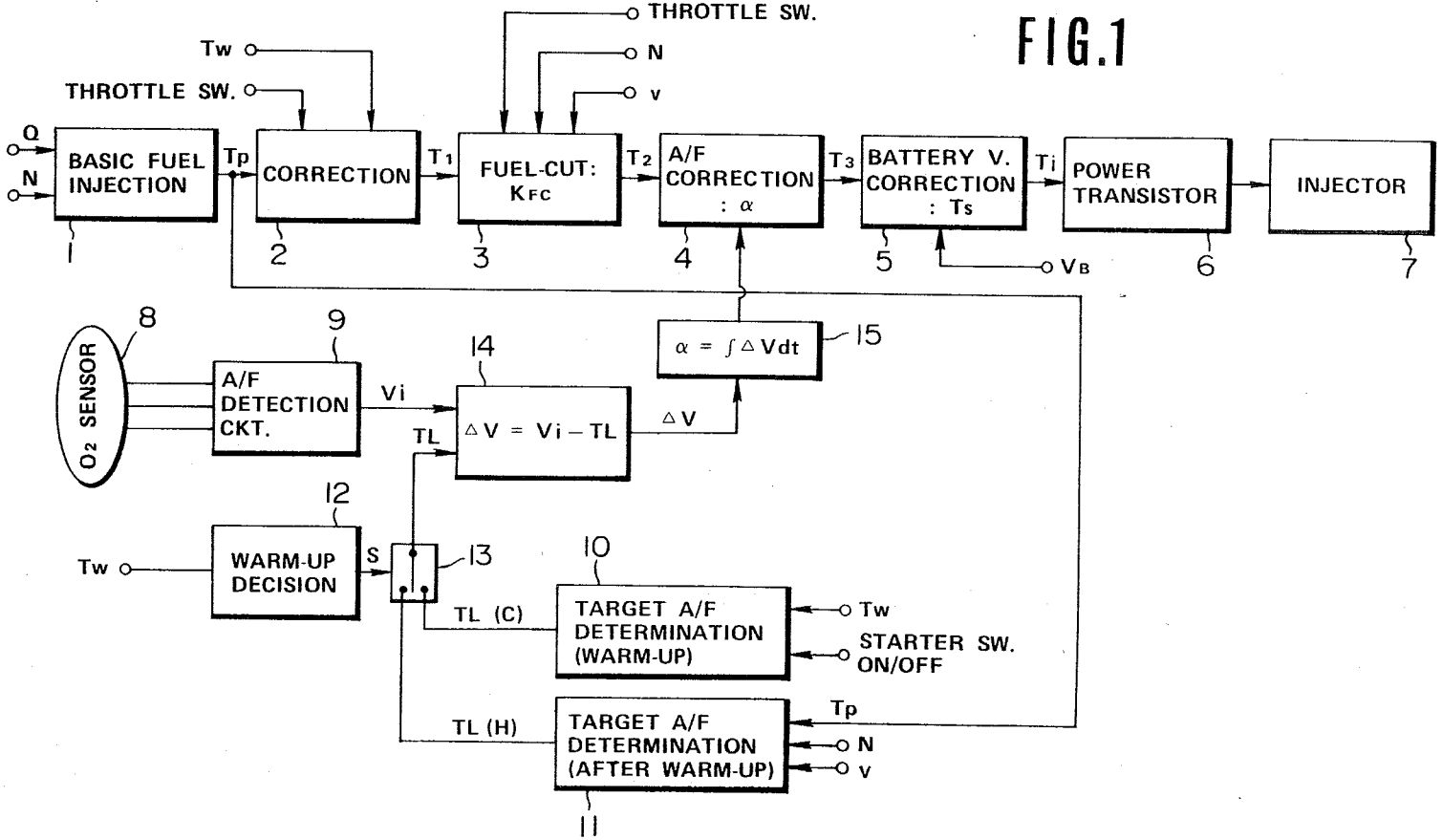
FIG. 1 is a block diagram of a first embodiment of an air-fuel ratio control aparatus according to the present invention.

Referring to FIG. 1, a first embodiment of an air-fuel ratio control apparatus according to the present invention is described wherein the present invention is embodied in an internal combustion engine installed with an electronically controlled fuel injection system which is well described in pages 32 to 40, 81 to 87 of the before mentioned technical paper "ECCS L-SERIES ENGINE" issued by Nissan Motor Company Limited in 1979.

The fuel injection system is briefly described. Referring to FIG. 1, a basic fuel injection calculation portion 1 calculates a basic amount of fuel injection Tp per each engine revolution in response to an intake air flow indicative signal Q from an air flow meter (not shown) and an engine revolution speed indicative signal N from an engine speed sensor, such as a crank angle sensor (not shown). This basic amount of fuel injection Tp is corrected by engine operating condition related correction coeffecients determined by an operating condition related correction portion 2 in response to each operating condition of the engine, a fuel-cut coefficient $K_{FC}$ determined by a fuel-cut related correction portion 3, and an air-fuel ratio feedback correction coefficient $\alpha$ in an air-fuel ratio related correction portion 4 and a battery voltage correction Ts determined by a battery voltage correction portion 5. The grand total of the basic amount of fuel injection Tp after being subjected to such corrections, which is designated by Ti, is generated in terms of a pulse width of a pulse signal supplied to an actuator in the form of a power transistor 6. The power transistor 6 causes the fuel injector 7 to be opened for a duration corresponding to the pulse width indicated by the signal Ti.

The feedback related correction coeffecient $\alpha$ is determined by a sensing element in the form of a wide-range detectable oxygen sensor 8, an air-fuel ratio detection circuit 9, a first target value determination portion 10 for warming-up operation of the engine, a second target value determination portion 11 for normal operation of the engine after warming-up, a warming-up decision portion 12, a switch 13, a difference calculation portion 14, and an air-fuel ratio feedback correction coefficient calculation portion 15.

Now, the operation of each of the above mentioned portions is further described.

In the basic fuel injection calculation portion 1, the basic amount of fuel injection Tp per each revolution of the engine is calculated for the intake air flow Q and engine revolution speed N.

In the operating condition related correction portion 2, the basic amount of fuel injection Tp is corrected in response to an engine coolant temperature Tw, an ON/-OFF signal generated by a throttle switch and other operation parameter related signals (i.e., a coolant temperature related correction, a start-up and after-start-up related correction, an after-idle correction and an air-fuel related correction) so as to provide a value $T_1$.

In the fuel-cut related correction portion 3, a fuel-cut coefficient (i.e., the coefficient taking zero (0) at fuel-cut and otherwise one (1)) is determined in response to ON/OFF of the throttle switch, engine revolution speed N, and vehicle speed v, and this correction coefficient is multiplied with the value $T_1$ to provide a value $T_2$.

In the air-fuel ratio related correction portion 4, a correction coefficient $\alpha$ calculated by the feedback correction coefficient calculation portion 15 is multiplied with $T_3$.

In the battery voltage correction portion 5, the value $T_3$ is corrected in response to a battery voltage $V_B$, thus giving the grand total Ti indicative of the desired amount of fuel injection in terms of a pulse width signal. With this pulse, the power transistor 6 causes the injector 7 to be actuated for a time period corresponding to the pulse width indicated by Ti, thus allowing the injection of fuel for the time period.

Fuel (for example, gasoline) injected by the injector 7 is mixed with intake air to form a fuel mixture that in turn is supplied to each engine cylinder for combustion therein.

The air-fuel ratio of this mixture is primarily adjusted in response to the operating condition detected by the above mentioned portions. The air-fuel ratio is further adjusted via feedback control (closed loop control) which is performed by the following portions.

The wide-range detectable oxygen sensor 8 and the air-fuel ratio detection circuit 9 cooperate with each other to continuously detect the air-fuel ratio over a wide range from a rich range portion thereof to a lean range portion thereof and outputs the detection result in terms of an electric voltage signal Vi. The detail of this wide-range detectable oxygen sensor 8 and the air-fuel ratio detection circuit 9 is described later.

In the first target value determination portion 10 for warming-up operation, a target value TL(C), in air-fuel ratio, which is to be attained for warming-up operation of the engine is determined in response to the presence of an ON signal from a startor switch and an engine coolant temperature indicative signal Tw from an engine coolant sensor (not shown). The result is generated in terms of a magnitude to be assumed by the electric voltage signal Vi.

In the second target value determination portion 11 for normal operation after warming-up, a target value TL(H), in air-fuel ratio, which is to be attained for normal operation after warming-up is determined in response to the basic amount of fuel injection Tp, engine revolution speed N and vehicle speed v. The result is generated in terms of a magnitude to be assumed by the electric voltage signal Vi.

In the warming-up decision portion 12, a comparison is made between the engine coolant temperature indicative signal Tw and a reference to decide whether or not the warming-up operation is underway, and a decision-result dependent signal S (for example, "0" represents warming-up operation, "1" normal operation after warming-up) is generated.

In response to this signal S, the switch 13 operates such that it assumes a position where the target value TL(C) is selected and fed to the difference calculation portion 14 as a target value TL during warming-up operation, and after the warming-up operation has been completed, it assumes another position where the target value TL(H) is selected and fed to the difference calculation portion 14 as the target value TL.

In the difference calculation portion 14, there is given a difference between the electric signal Vi indicative of an actual air-fuel ratio detected by the air-fuel ratio detection circuit 9 and the target value TL, the difference being designated by ΔV (and expressed by $\Delta V = Vi - TL$).

In the feedback correction coefficient calculation portion 15, this difference ΔV is integrated to calculate the air-fuel ratio feedback correction coeffecient $\alpha$ which is fed to be fed to the air-fuel ratio related correction portion 4.

In the air-fuel ratio related correction portion 4, the correction is made by multiplying this air-fuel ratio feedback correction coefficient $\alpha$ with the value $T_2$ (there occurs no feedback correction if $\alpha = 1$). The feedback control of the air-fuel ratio is carried out because $\alpha$ is variable so as to adjust the actual air-fuel ratio to the target value.

All of the portions mentioned heretofore except the power transistor 6, injector 7 and the wide-range detectable oxygen sensor 8 may be formed within a control unit. Virtually, the operation of these portions may be implemented by a microcomputer which includes as usual CPU, ROM and RAM.

The operation of each of the first target value determination portion 10 and the second target value determination portion 11 includes retrieving data stored in the ROM.

The target values which may be determined by the target value determination portion 10 designate air-fuel ratio values displaced to the rich side from the stoichometric ratio for the mixture supplied to the engine and they are set, for example, by the following equation:

$$TL(C) = f_1 + f_2$$

$f_1$: Basic target value.

Figure 2:
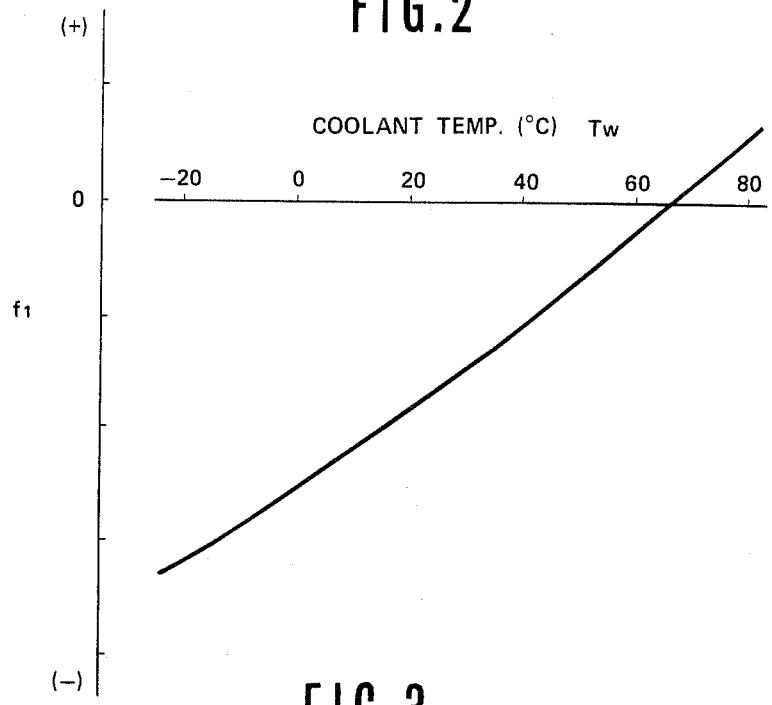
FIG. 2 is a graph showing how a basic target value $f_1$ varies versus coolant temperature.

This basic target value $f_1$ varies versus the engine coolant temperature Tw as shown in FIG. 2 such that a single target value is given at any temperature value and designates basic target air-fuel ratios suitable for optimal cold engine operation (warming-up).

$f_2$: Correction value after cranking.

Figure 3:
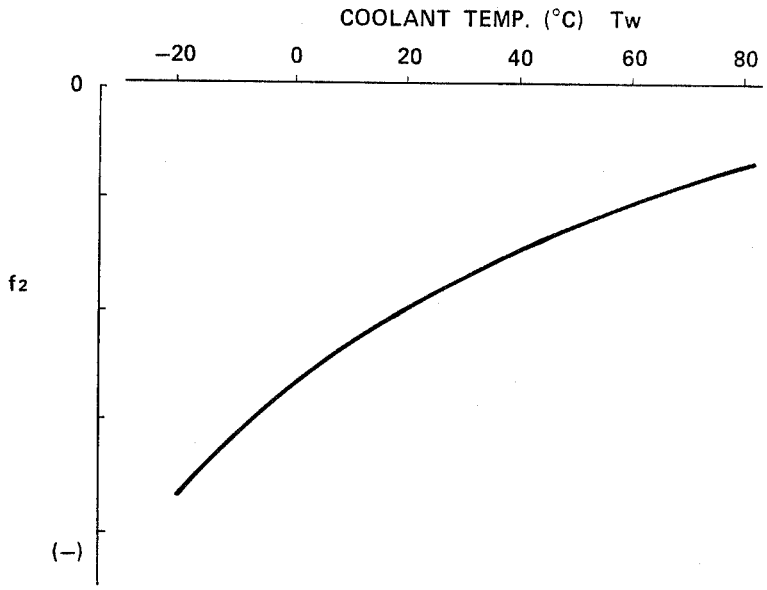
FIG. 3 is a graph showing how an after-cranking correction value $f_2$ varies verus coolant temperature.

This correction value decreases toward zero (at a predetermined rate) versus time from an initial value $f_2(o)$ that is given by the curve shown in FIG. 3 for a temperature in engine coolant at the time of cranking.

As described above, the target value TL(C) for warming-up operation of the engine is determined by the temperaturte of the engine (i.e., the engine temperature may include not only an engine coolant temperature, but also a temperature obtained by directly detecting cylinder head or cylinder block) immediately after cranking of the engine, and the engine temperature after the cranking and a time lapsed from the cranking.

If desired, it may be allowed to change the target value not only on the engine temperature and the time lapsed, but also whether or not the engine idles.

In the manner described above, the target value TL(C) is given which designates the optimal air-fuel ratio at any instance during warming-up operation after cranking of the engine, and the feedback control is carried out to adjust the electric voltage Vi to this target value TL.

As a result of this feedback control, the air-fuel ratio is always adjustable to the optimal ratio without any deviation therefrom, such as too rich or too lean, during warming-up operation even if the engine, the intake air sensor and the fuel injector are subject to performance variations.

During normal operation after warming-up, the switch 13 is shifted to the position where the second target value determination portion 11 is selected and the feedback control is carried out.

Target value TL(H) determined by this target value determination portion 11 usually corresponds to the stoichiometric ratio for the mixture. Preferrably, the setting of the target value should be such that the air-fuel ratio is slightly greater than the stoichiometric ratio to provide a lean mixture during normal operation for the purpose of improving fuel economy, while it is less than the stoichiometric ratio to provide a rich mixture for acceleration in order to boost the engine output.

Although, in the preceding description, the invention has been described as being embodied in association with the engine installed with electronically controlled fuel injection system, it may well be embodied in association with an engine with a carburetor of the electronically controlled carburetor type (ECC) which is well described in a technical paper "NAPS THREE-WAY CATALYST SYSTEM" issued by Nissan Motor Company Limited in 1978.

In this case, the carburetor determines the basic amount of fuel supply for each engine operating condition, and the feedback control of the air-fuel ratio is carried out by an ECC feedback solenoid valve assembly mounted on the main and slow systems of the carburetor such that the amount of fuel supplied to the engine is increased or decreased in response to a correction coefficient $\alpha$ that is determined by an air-fuel ratio coeffecient calculation portion.

Figure 4:
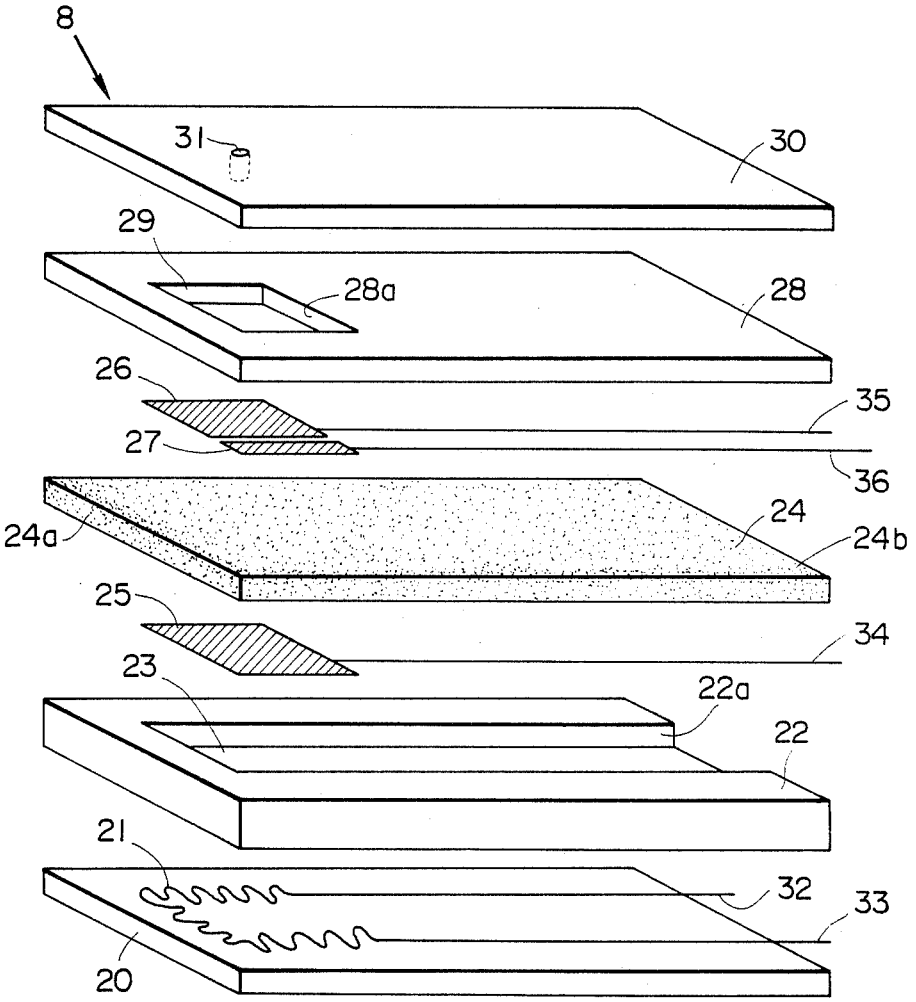
FIG. 4 is an exploded perspective view of a sensing element used in the control apparatus shown in FIG. 1.
Figure 5:
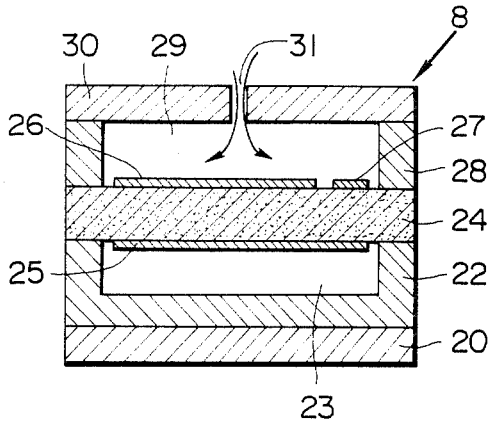
FIG. 5 is a cross sectional diagram of the sensing element shown in FIG. 4 in its assembled state.

Referring to FIGS. 4 and 5, the sensing element (oxygen sensor) 8 is described. The sensing element 8 comprises a parition 24 in the form of an oxygen ion-conductive soild electrolyte which has a first side 24*a* and a second side 24*b*. The partition 24 defines on the first side 24*a* an atmospheric air receiving portion 23 communicating with the ambient atmosphere and on the second side 24*b* a gas receiving portion 29 communicating with the inside of an exhaust pipe (not shown) of the internal combustion engine. The partition 14 is interposed between first electrode means 25 and second electrode means (26, 27). The first electrode means 25 includes a thin electrode layer 25 printed on the first side 24*a* and exposed to the atmospheric air receiving portion 23, while the second electrode means includes a thin pump electrode layer 26 and a thin sensor electrode layer 27 which are arranged side by side.

Figure 6:
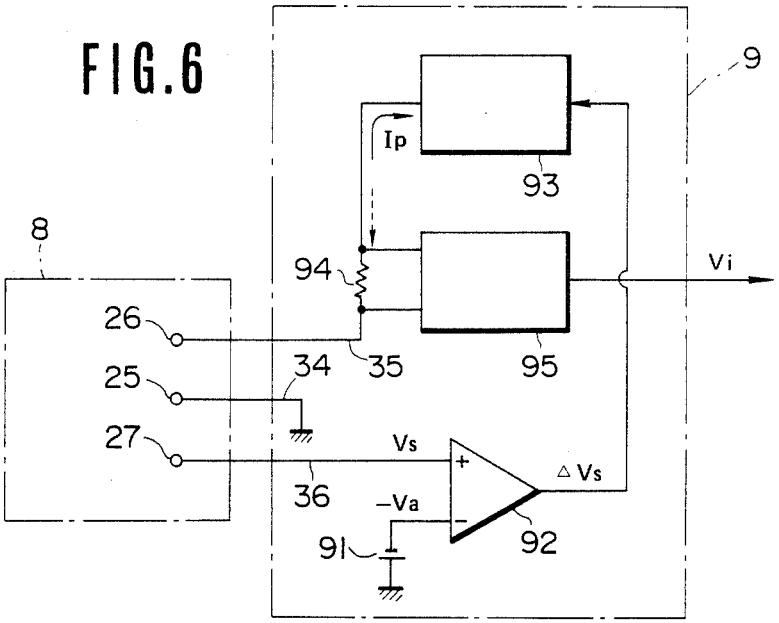
FIG. 6 is a block diagram of a device, using the sensing element shown in FIGS. 4 and 5, for detecting an air-fuel ratio.

Referring to FIG. 4, there is shown a base plate 20 with an electrical heater 21 for heating the partition 24 of the oxygen ion-conductive solid electrolyte. Lying on the base plate 20 is an atmospheric air receiving plate 22 formed with a channel-like gutter 22*a* closed at one end. Lying on the atmospheric air receiving plate 22 is the partition 24 having printed on the first side thereof 24*a* the reference electrode layer 25 and on the opposite second side thereof 24*b* the pump and sensor electrode layers 26 and 27. The heater 21 has leads 32 and 33, and the electrode layers 25, 26 and 27 have leads 34, 35 and 36 connected as shown in FIG. 6. For restricting gas diffusion of the exhaust gases to the electrode layers 26 and 27, a plate 28 is laid on the second side 24*b* of the partition 24, which plate 28 is formed with a window-like opening 28*a* defining the side boundary of the gas receiving portion 29, and another plate 30 is laid on the plate 28. This another plate 30 is formed with a small hole 31 for resticting gas flow communication between the gas receiving portion 29 and the ambient exhaust gas environment within the exhause pipe.

The base plate 20, atmospheric air receiving plate 22 and plates 28, 30 are formed of a heat resistive insulator, such as alumina and mullite or a heat resistive alloy. The solid electrolyte 24 is formed of a sintered body obtained by solidifying at least one selected from $C_2O$, MgO, $Y_2O_2$, $YB_2O_3$ into an oxide such as $ZrO_2$, $HrO_2$, $ThO_2$, $Bi_2O_3$.

Each of the electrode layers 25, 26 and 27 includes platinum or gold as a main constituent thereof. The pump electrode 26 and the reference electrode 25 serve as electrodes which allows electric current to pass through the solid electrolyte 24 to cause the migration of oxygen ion within the solid electrolyte 24 so as to keep an oxygen partial pressure ratio, viz., a ratio between oxygen partial pressure at one side of the solid electrolyte and exygen partial pressure at the other side thereof, constant. The sensor electrode layer 27 and the reference electrode layer 25 serve as electrodes for measuring an electric voltage developed across the solid electrolyte 24 due to the oxygen partial pressure ratio.

Referring to FIG. 6, the electrode layers 25, 26 and 27 are circuited with the detecting circuit 9 (see FIG. 1, too). The circuit 9 comprises a source of electric voltage 91 which generates a target electric voltage $-Va$, a differential amplifier 92, a pump electric current supply unit 93, a resistor 94 and a pump electric current detecting unit 95 which detects the pump electric current by measuring an electric voltage across the resistor 94 and generates the voltage Vi.

The differential amplifier 92 compares a potential Vs of the reference electrode 25 of the sensing element 8 relative to the sensor electrode 27 with the target electric voltage $-Vs$, and calculates the difference therebetween $\Delta V$ ($\Delta V = Vs - (-Va)$). The pump electric voltage supply unit 93 regulates an outflow of the pump electric current Ip from the pump electrode 26 of the sensing element 8 (or an inflow thereto) so as to reduce the output $\Delta V$ of the differential amplifier 92 toward zero. That is, when the output $\Delta V$ is positive, Ip is increased, whereas when the output $\Delta V$ is negative, Ip is decreased.

The pump electric current detecting unit 95 detects the pump electric current Ip by measuring a difference in electric potential across the resistor 94 in terms of the electric voltage Vi ($Vi \propto Ip$). The direction of flow of the pump electric current Ip as indicated by the fully drawn arrow in FIG. 6 is regarded as the positive direction and in this case the electric voltage Vi detected becomes positive, whereas when the direction of the pump electric current is negative as indicated by a broken arrow, the electric voltage Vi becomes negative.

The mechanism of the sensing element 8 is described hereinafter in connection with the detecting circuit 9.

Although any value may be set as the target electric voltage $-Va$ generated by the source of electric voltage 91 as long as it corresponds to a value which may be taken by the electric voltage Vs generated at the sensor electrode 27, it is preferrable for the purpose of accurately converging the sensor voltage Vs to the target value that the target electric voltage should take a value at which a tangent in variation in the sensor voltage Vs versus variation in oxygen concentration within the gas receiving portion 29 is the largest, that is, a middle value between the upper and lower limits between which the electric voltage rapidly changes versus variation in the oxygen concentration.

If $-500$ mV is set as the target value $-Vs$, the pump electric current supply unit 93 controls the supply of the pump electric current Ip in such a manner as to accomplish the relationship; $Vs = -500$ mV. Assuming that the temperature T is 1000 K, the oxygen partial pressures Pa and Pg within the atmospheric air receiving portion 23 of the sensing element 8 and the gas receiving portion 29 thereof shall satisfy the following relationship which has been obtained by using the Nernst's equation;

$$Pg/Pa \approx 10^{-10}.$$

Substituting $Pa = 0.206$ atm, $Pg \approx 0.206 \times 10^{-10}$atm.

Assuming the oxygen partial pressure within the exhaust gases is Px, the quantity Q of oxygen $O_2$ entering the gas receiving portion 19 past the small hole 21 can be expressed as $Q = D\ (Px - Pg)$, where D is the diffusion coefficient. Since $Pg = 0$, $$Q \approx D\ Px \qquad (1).$$

Since the quantity of oxygen ion $O^{2-}$ migrating within the solid electrolyte 14 is as high as this quantity Q, the following relation Ip Q holds. Thus, $$Ip = K_1 Px \quad (2)$$

$K_1$: a constant.

The pump electric current Ip therefore varies in proportion to the oxygen partial pressure (oxygen concentration) within the exhaust gases.

Since the oxygen concentration is closely related to the air-fuel ratio when the air-fuel ratio (A/F) of the mixture fed to the internal combustion engine is on the lean side ($\lambda > 1$), it is apparent that the air-fuel ratio can be accurately detected with this circuit.

Since the oxygen partial pressure Px within the exhaust gases ranges from $10^{-20}$ to $10^{-25}$ (equilibrium oxygen partial pressure). When the air-fuel ratio is on the rich side ($\lambda > 1$), the relationship $Ip = 0$ should result from calculation using the equation (2).

However, when the air-fuel ratio is on the rich side, the exhaust gases contain much activate gases, HC and CO, for example. Taking CO as an example, the migration of oxygen ion in the opposite direction from the atmospheric air receiving portion 23 side to the gas receiving portion 29 side is needed so as to establish the relationship $Pg = 10^{-10} \times 0.206$ provided Px is between $10^{-20}$ and $10^{-25}$.

However, the oxygen $O_2$ having migrated to the surface of the pump electrode 16 of the gas receiving portion 19 is consumed by the reaction as expressed by an equation as follows, $$2CO + O_2 \rightarrow 2CO_2 \quad (3).$$

Thus, when the air-fuel ratio is on the rich side, the rate of consumption of the oxygen $O_2$ by the reaction expressed by the equation (3) is measured in terms of the pump electric current Ip. In other words, what is measured is the rate of the reaction expressed by the above equation (3).

The rate of reaction expressed by the equation (3) is proportional to the amount of CO flowing into the gas receiving portion 29 past the small hole 31. Since the CO partial pressure within the gas receiving portion 29 is almost zero due to the consumption by the reaction expressed by the equation (3), the amount (Qco) of CO flowing into the gas receiving portion 29 past the small hole 31 is expressed by, $$Qco = D' (Pco - Pg)$$

where: Pco is the CO partial pressure within the exhaust gases and D' the diffusion coefficent. Substituting $Pg \approx 0$, $$Qco = D' Pco.$$

Therefore, the amount of $O_2$ migrated by pumping from the atmospheric air receiving portion 23 by means of the pump electric current Ip is proportional to the amount of $O_2$ necessary to keep the oxygen partial pressure Pg within the gas receiving portion 29 at the value $0.206 \times 10^{-10}$. In other words, the pump current Ip is proportional to the concentration of CO within the exhaust gases.

When the air-fuel ratio is on the rich side, the concentration of CO (or CO+HC) is closely related to the air-fuel ratio, the air-fuel ratio can be accurately and continuously detected by measuring the pump current Ip even if the air-fuel ratio is on the rich side.

Figure 7:
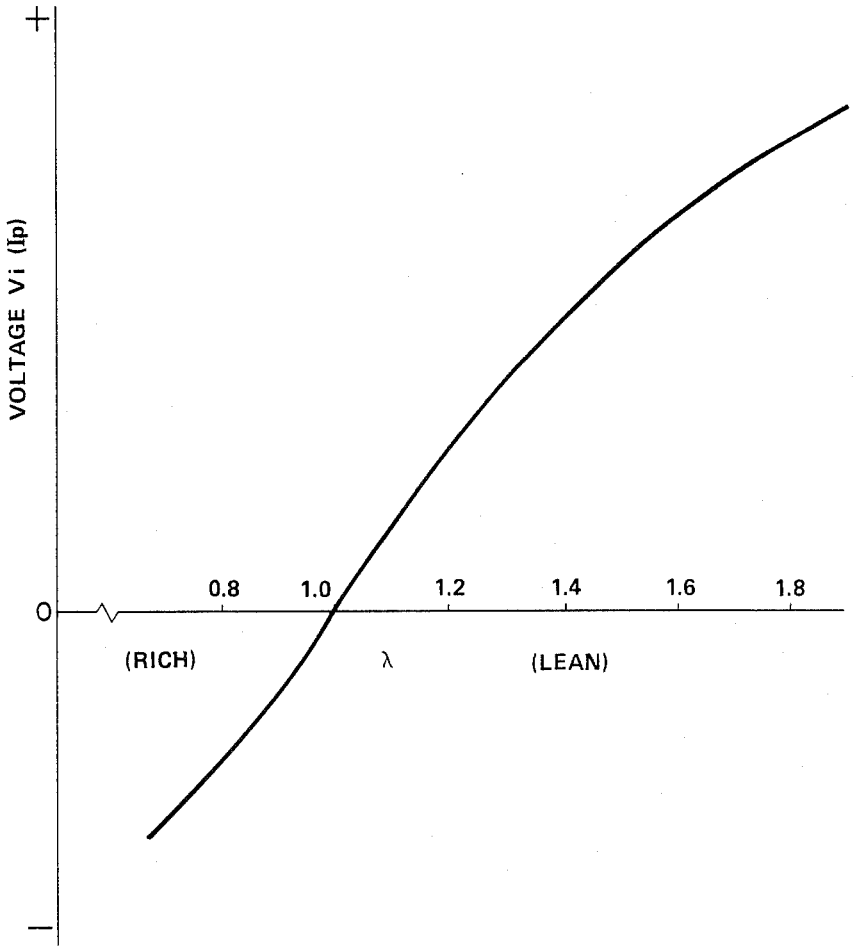
FIG. 7 is a graph showing the relationship between a measured voltage (Vi) and air-fuel ratio ($\lambda$)

Thus, the electric voltage Vi that is proportional to the pump current Ip detected by the detecting circuit 9 shown in FIG. 6 varies singularly and continuously with the variation in air-fuel ratio over a wide range from below the stoichiometric ratio to above the stoichiometric ratio as shown in FIG. 7.

Figure 8:
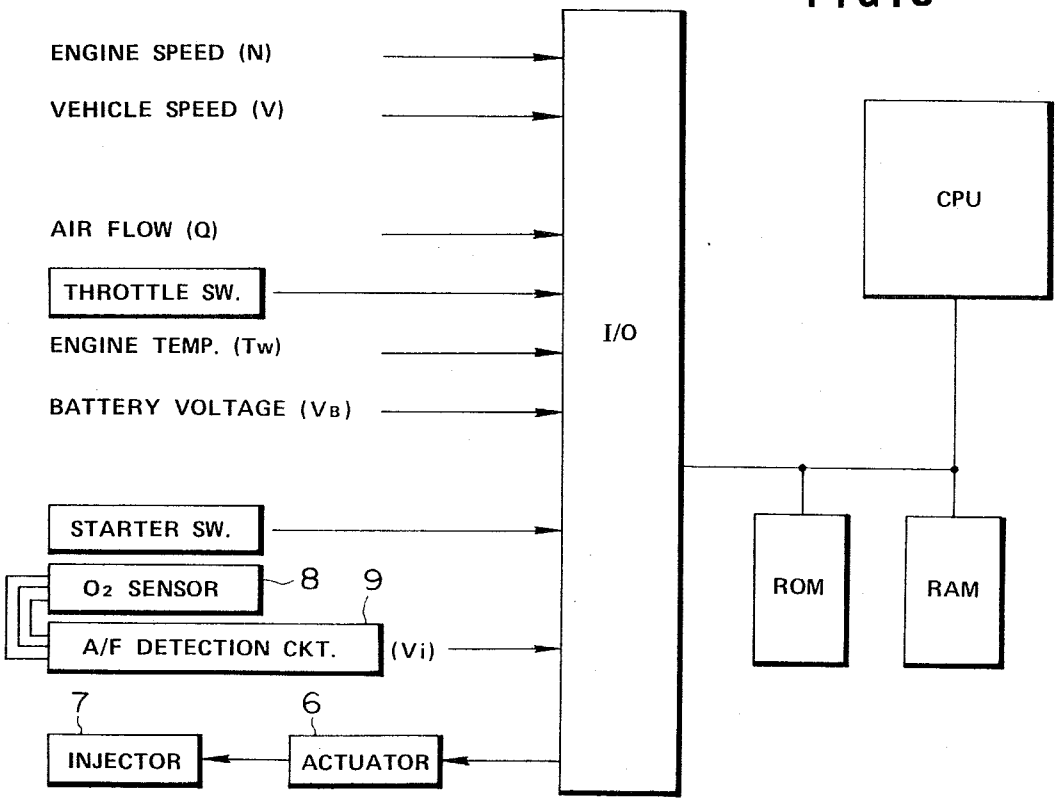
FIG. 8 is a second embodiment where the operation of the first embodiment is carried out by an apparatus using a microcomputer.

The control operation employed by the air-fuel ratio control apparatus shown in FIG. 1 may be carried out by an apparatus using a microcomputer as shown in FIG. 8.

FIG. 8 shows the microcomputer which includes usual components, such as RAM, ROM, CPU, I/O interface etc., as well known in the art.

Figure 9:
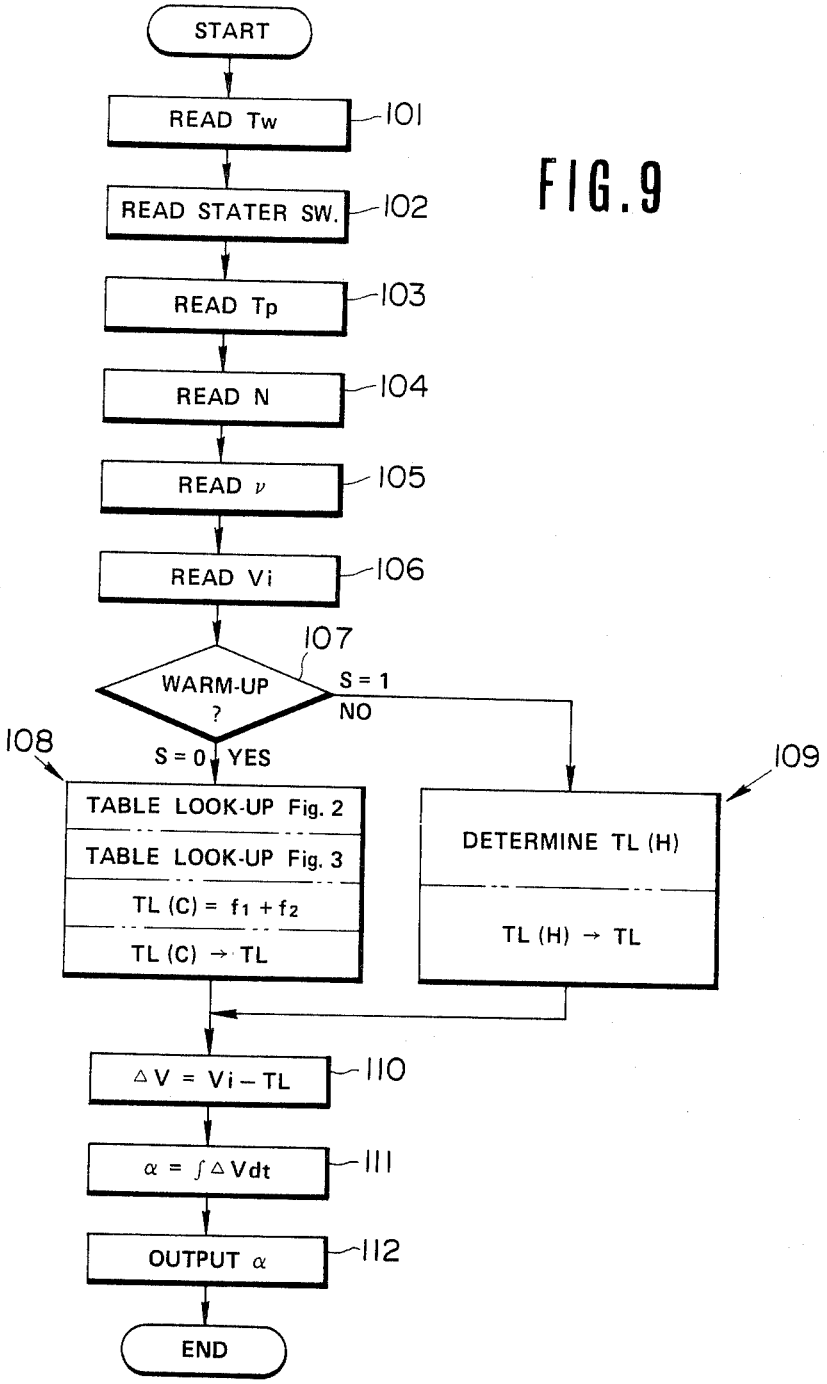
FIG. 9 is a flowchart of an interrupt routine of a control program stored in a ROM of the microcomputer shown in FIG. 8.

FIG. 9 is a flowchart implementing the embodiment described in connection with FIG. 1.

Referring to FIG. 9, an engine temperature, such as engine coolant temperature, Tw is read in a step 101, an ON/OFF state of a starter switch is read in a step 102 for use in determining a cranking operation of the engine, a basic amount of fuel injection Tp is read in a step 103, an engine revolution speed N is read in a step 104, a vehicle speed v is read in a step 105, and an output voltage Vi from a detection circuit 9 is read in a step 106. Then a decision is made in a step 107 whether or not warming-up is underway by comparing the engine temperature Tw with a reference value. When the answer of the step 107 is YES (i.e., if the warming-up is underway), a target air-fuel ratio TL(C) for warming-up operation is determined in a step 108, while when the answer of the step 107 is NO (i.e., when the warming-up operation has been completed), a target air-fuel ratio for normal operation after warming-up is determined in a step 109. In the step 108, values $f_1$ and $f_2$ are retrieved by table look-up of FIGS. 2 and 3 using the state of the starter switch obtained in the step 103 and the engine temperature Tw obtained in the step 101, and the value $f_1$ is added to the value $f_2$ to give a TL(C) which is then set as TL. In the step 109, the target air-fuel ratio TL(H) for normal opeation after warming-up is determined for each operating state of the engine determined in response to Tp, N and v obtained in steps 103, 104 and 105, respectively. Then, TL(H) is set as TL in the step 109.

A difference $\Delta V$ is calculated in a step 110 by subtracting TL from Vi that is read in the step 106. In the next step 111, the difference $\Delta V$ is integrated with respect to time t to give an air-fuel ratio feedback correction coefficient $\alpha$. The correction coefficient $\alpha$ thus obtained in the step 111 is generated in a step 112 for use in correcting the amount of fuel injection.

Figure 10:
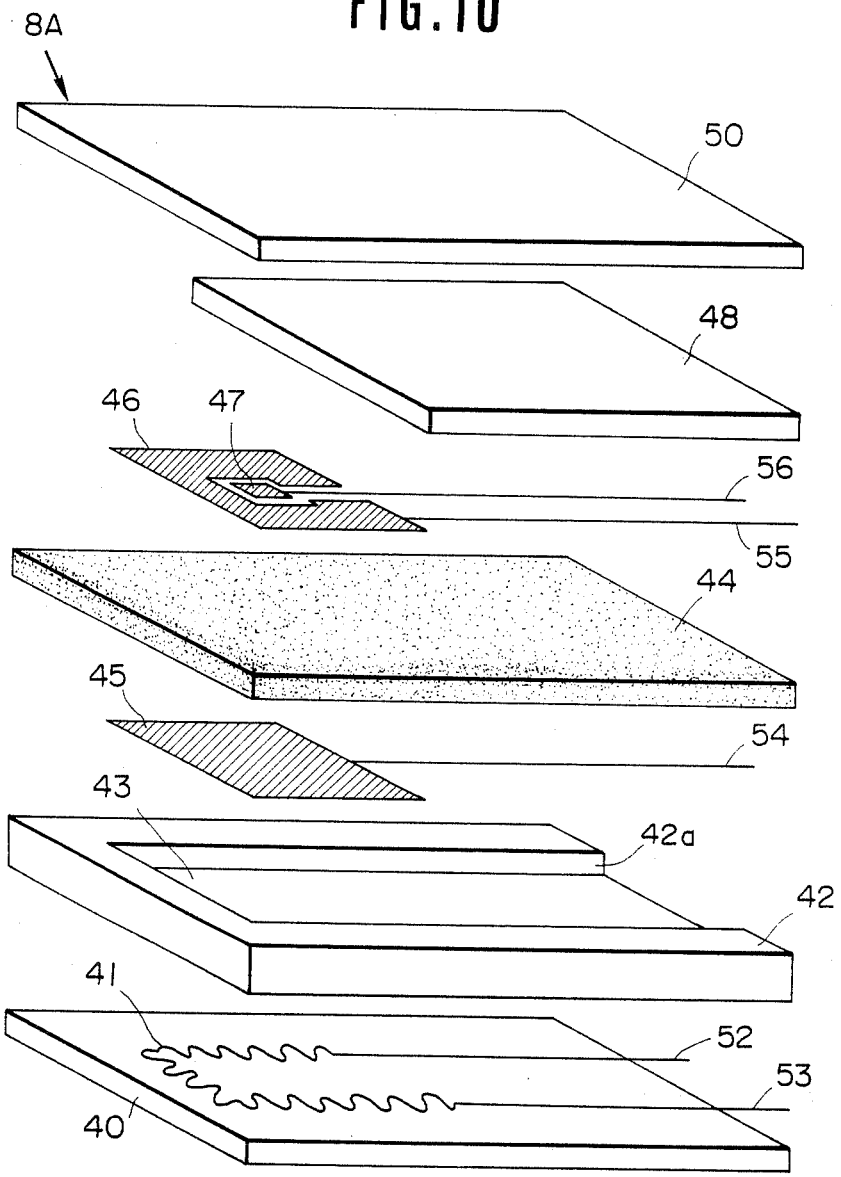
FIG. 10 is a similar view to FIG. 4 showing a second example of a sensing element.
Figure 11:
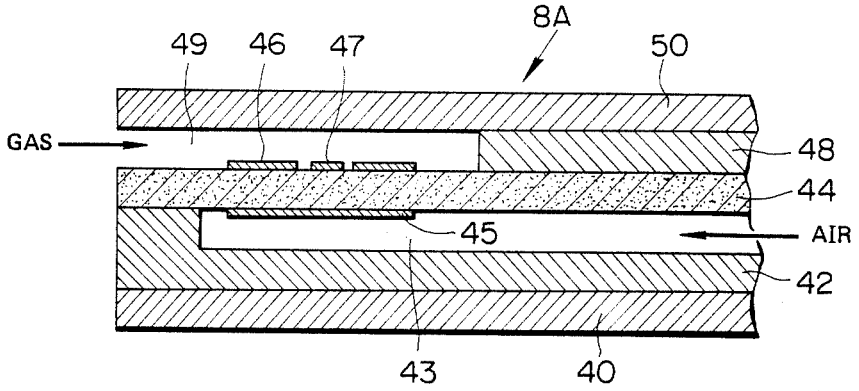
FIG. 11 is a longitudinal cross sectional diagram of the sensing element shown in FIG. 10.

Referring to FIGS. 10 and 11, a second example of a sensing element is described. This sensing element which is now designated by the reference numeral 8A features that a clearance defined between two plates serves not only as a gas receiving portion but also as means for restricting diffusion of gas.

Referring to the structure of this sensing element 8A, similarly to the sensing element 8, there is a base plate 40 with a heater 41 and lying on the base plate is an atmospheric air receiving plate 42 formed with a channel-like gutter **42*a* defining an atmospheric air receiving portion 43. Lying on the atmospheric air receiving plate 42 is a partition of an oxygen ion-conductive solid electrolyte 44**.

Similarlity to the sensing element 8 exists till forming a rectangular thin electrode layer 45 on the solid eletrolyte 44. However, there is a difference that a pump electrode layer 46 and a sensor electrode layer 47 which are to be arranged in opposed relationship with the reference electrode layer 45 are formed such that the pump electrode layer 46 is of rectangular and has the sensor electrode layer 47 disposed in the center rectangular opening formed through the center portion thereof in such a manner as to surround the outer periphery of the latter.

A plate 50 is connected to the solid electrolyte 44 with a spacer 48 interposed therebetween (the spacer may be replaced with an adheasive layer), leaving a distance (0.1 mm, for example), creating a clearance 49 between the electrode arranged portion of the solid electrolyte 44 and the plate 50, causing this clearance 49 to serve as means for restricting diffusion of gas.

Designated by 52, 53 in FIG. 10 are leads for the heater 41, designated by 54 to 56 are leads for the reference electrode 45, pump electrode 46 and sensor electrode 47, respectively. The materials of the component parts of this embodiment are similar to the sensing element 8.

Similarly to the sensing element 8, the air-fuel ratio of the mixture fed to the internal combustion engine can be continuously and accurately detected over the wide range from the rich side to the lean side by means of a detecting circuit similar to that shown in FIG. 6.

Since the diffusion of gas is restricted by the clearance which is open to the environment filled with gas to be measured at a plurality of sides thereof (three sides in this example), there occurs little infuence on the diffusion restricting performance owing to the deposit of the components of the exhaust gases, thus ensuring stable operation over a prolonged time. The distance and shape formed by the clearance may be easily varied as desired by varying the thickness of the spacer 48, thus making the design change and quality control easy.

Figure 12:
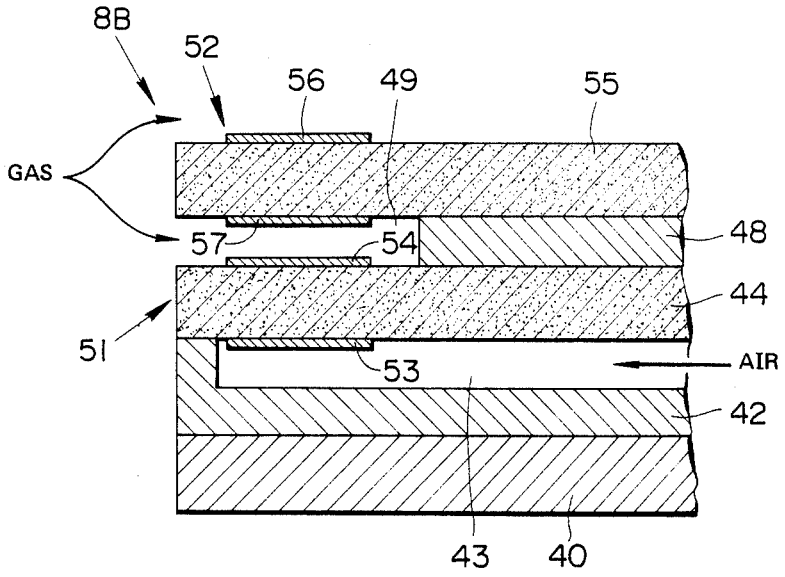
FIG. 12 is a similar view to FIG. 11 showing a third example of a sensing element.

FIG. 12 is a longitudinal view similar to FIG. 11 showing still another example of a sensing element 8B and uses the same reference numerals as used in FIGS. 10 and 11 to designate similar parts.

This sensing 8B features in the separate provision of a sensor section 51 from a pump section 52. A sensor cathode 53 is printed on a solid electrolyte 44 at a side exposed to an atmospheric air receiving portion 43, and a sensor anode 54 is printed on the solid electrolyte 44 at a side exposed to an exhaust gas receiving portion 49. The plate like body 50 used in FIGS. 10 and 11 has been replaced with an oxygen ion-conductive solid electrolyte 55, a pump electrode 56 is printed on the outer side of the solid electrolyte 55 and a pump cathode 57 is printed on a side of the electrolyte 55 exposed to the clearance 49.

Preferrably, a thin porous protective layer is used to cover the sensor section 51 so as to prolong endurability.

In use, the sensor cathode 53 and the pump cathode 57 are grounded and is circuited with a detection circuit 9 as shown in FIG. 6. This allows a detection of an air-fuel ratio over a wide range from a rich range portion thereof to a lean range portion thereof only by detecting the magnitude of a pump current Ip flowing between the pump anode 56 and the pump cathode 57 under a condition where a potential of the sensor anode 54 is maintained at a predetermined value.

The oxygen element which may be used to embody the present invention is not limited to the above examples, and any sensor element may be used as long as it can continuously detect the air-fuel ratio over a wide range from a rich range portion thereof to a lean range portion thereof.

I claim:

1. An air-fuel ratio control apparatus for controlling an air-fuel ratio of a fuel mixture supplied to an internal combustion engine which effects combustion of the fuel mixture to produce exhaust gases, comprising:

means for detecting the air-fuel ratio of the fuel mixture over a range from a rich range portion thereof to a lean range portion thereof by probing the exhaust gases resulting from combustion of the fuel mixture and generating an actual air-fuel ratio indicative signal;

means for detecting a warming-up operation of the internal combustion engine and generating a warming-up operation indicative signal;

means for determining a first target value indicative of an air-fuel ratio value optimal for warming-up operation in response to the presence of said warming-up operation indicative signal, determining a second target value indicative of an air-fuel ratio value for normal operation of the internal combustion engine after the warming-up operation in response to the absence of said warming-up operation indictive signal, and generating a target value indicative signal indicative of said first target value in response to the presence of said warming-up operation indicative signal and said second target value in response to the absence of said warming-up operation indicative signal;

means for comparing said actual air-fuel ratio indicative signal with said target value indicative signal and generating a difference indicative signal indicative of a difference therebetween; and means for controlling the air-fuel ratio of the fuel mixture in response to said difference indicative signal in such a manner as to reduce said difference indicative signal to zero, wherein said air-fuel ratio detecting means comprises:

a partition having a first side and a second side opposite to said first side, said partition defining on said first side an atmospheric air receiving portion communicating with the ambient atmosphere and on said second side a gas receiving portion communicating with a source of the exhaust gases;

said partition having at least a portion formed of an oxygen ion-conductive solid electrolyte;

first electrode means exposed to said atmospheric air receiving portion;

second electrode means exposed to the exhaust gases;

means for restricting gas diffusion of said exhaust gases to said gas receiving portion;

current providing means for providing an electric current to flow between said first and second electrode means through said electrolyte in such a manner as to cause migration of oxygen ions through said electrolyte between said atmospheric air receiving portion and said gas receiving portion so as to keep an oxygen partial pressure ratio across said electrolyte constant; and means for detecting said electric current.

2. An air-fuel ratio control apparatus as claimed in claim 1, wherein said first target value is variable versus an engine temperature immediately after cranking operation of the engine and a time lapsed from the cranking operation.

3. An air-fuel ratio control apparatus as claimed in claim 1, wherein said gas diffusion restricting means includes:

a first plate lying on said second side of said partition, said first plate being formed with an opening; and a second plate lying on said first plate to close said opening, said partition, said first plate and said second plate cooperating with each other to define said gas receiving portion within said opening, said second plate being formed with a gas flow restricting hole for providing restricted flow communication between said gas receiving portion and the source of the exhaust gases.

4. An air-fuel ratio control apparatus as claimed in claim 1, wherein said gas diffusion restricting means includes:

a plate lying on said second side of said partition and having a portion spaced distant from said second side of said partition to define a clearance therebetween, said plate and said partition cooperating with each other to define said gas receiving portion within said clearance.

5. An air-fuel ratio control apparatus as claimed in claim 4, wherein said plate is formed of an oxygen ion-conductive solid electrolyte.

6. An air-fuel ratio control apparatus as claimed in claim 1, wherein said first electrode means includes an electrode layer printed on said electrolyte.

7. An air-fuel ratio control apparatus as claimed in claim 6, wherein said electrode layer of said first electrode means is grounded.

8. An air-fuel ratio control apparatus as claimed in claim 1, wherein said second electrode means includes a pump electrode layer printed on said electrolyte of which said partition is formed and a sensor electrode layer printed on said electrolyte of which said partition is formed.

9. An air-fuel ratio control apparatus as claimed in claim 8, wherein said pump electrode layer and said sensor electrode layer are arranged side by side.

10. An air-fuel ratio control apparatus as claimed in claim 8, wherein said pump electrode layer is formed with an opening and said sensor electrode layer is arranged within said opening.

11. An air-fuel ratio control apparatus as claimed in claim 5, wherein said second electrode means includes a sensor anode printed on said electrolyte of which said partition is formed, a pump cathode printed on said plate formed of the electrolyte and a pump anode printed on said plate formed of the electrolyte, and said first electrode means includes a sensor cathode printed on said electrolyte of which said partition is formed.

12. An air-fuel ratio control apparatus as claimed in claim 1, further comprising a plate lying on said first side of said partition and formed with a gutter closed at one end, said plate cooperating with said first side of said partition to define said atmospheric receiving portion within said gutter.

13. An air-fuel ratio control apparatus as claimed in claim 1, further comprising electrical heating means for heating said electrolyte.

14. A method for controlling an air-fuel ratio of a fuel mixture supplied to an internal combustion engine which effects combustion of the fuel mixture to produce exhaust gases, comprising:

providing a sensing element comprising a partition having a first side and a second side opposite to said first side, said partition defining on said first side an atmospheric air receiving portion communicating with the ambient atmosphere and on said second side a gas receiving portion communicating with a source of the exhaust gases, said partition having at least a portion formed of an oxygen solid ion-conductive eletrolyte, first electrode means exposed to said atmospheric air receiving portion, second electrode means exposed to said gas receiving portion, said first and second electrode means interposing said electrolyte therebetween, and means for restricting gas diffusion of said exhaust gases to said gas receiving portion;

causing an electric current to flow between said first and second electrode means through said electrolyte in such a manner as to cause migration of oxygen ions through said electrolyte between said atmospheric air receiving portion and said gas receiving portion so as to keep an oxygen partial pressure ratio across said electrolyte constant;

detecting said electric current and generating an actual air-fuel ratio indicative signal;

detecting a warming-up operation of the internal combustion engine and generating a warming-up operation indicative signal;

determining a first target value indicative of an air-fuel ratio value optimal for warming-up operation in response to the presence of said warming-up operation indicative signal, determining a second target value indicative of an air-fuel ratio value for normal operation of the internal combustion engine after the warming-up operation in response to the absence of said warming-up operation indicative signal, and generating a target value indicative signal indicative of said first target value in response to the presence of said warming-up operation indicative signal and said second target value in response to the absence of said warming-up operation indicative signal;

comparing said actual air-fuel ratio indicative signal with said target value indicative signal and generating a difference indicative signal indicative of a difference therebetween; and controlling the air-fuel ratio of the fuel mixture in response to said difference indicative signal in such a manner as to reduce said difference indicative signal to zero.

* * * * *